US009370269B2

(12) United States Patent
Edwards et al.

(10) Patent No.: US 9,370,269 B2
(45) Date of Patent: Jun. 21, 2016

(54) PILLOW

(71) Applicant: D G Capital Limited, London (GB)

(72) Inventors: Barnaby Bevan Edwards, London (GB); Steven Richard Spong, London (GB)

(73) Assignee: D G CAPITAL LIMITED, London (GB)

( * ) Notice: Subject to any disclaimer, the term of this patent is extended or adjusted under 35 U.S.C. 154(b) by 29 days.

(21) Appl. No.: 14/263,029

(22) Filed: Apr. 28, 2014

(65) Prior Publication Data

US 2014/0304920 A1 Oct. 16, 2014

Related U.S. Application Data

(63) Continuation of application No. 12/689,289, filed on Jan. 19, 2010, now Pat. No. 8,856,991.

(30) Foreign Application Priority Data

Jan. 20, 2009 (GB) ..... 0900938.2

(51) Int. Cl.
*A47G 9/10* (2006.01)
*A47C 7/38* (2006.01)
*A47G 9/00* (2006.01)

(52) U.S. Cl.
CPC . *A47G 9/10* (2013.01); *A47C 7/383* (2013.01); *A47G 9/1027* (2013.01); *A47G 2009/003* (2013.01)

(58) Field of Classification Search
CPC . A47G 9/10; A47G 9/1027; A47G 2009/003; A47C 7/383
USPC ..... 5/644
See application file for complete search history.

(56) References Cited

U.S. PATENT DOCUMENTS 2,336,707 A * 12/1943 Thompson ..... 5/636
2,835,905 A 5/1958 Tomasson (Continued)

FOREIGN PATENT DOCUMENTS

CN 2602679 Y 2/2004
CN 201022564 Y 2/2008

(Continued)

OTHER PUBLICATIONS

Office Action issued by the State Intellectual Property Office of P.R. China, Jun. 6, 2013.

(Continued)

*Primary Examiner* — Nicholas Polito
*Assistant Examiner* — Myles Throop
(74) *Attorney, Agent, or Firm* — Gottlieb, Rackman & Reisman, PC

(57) ABSTRACT

A pillow that includes two sheets of flexible material, joined together to define a space and that is inflatable to provide a cushioned support. The pillow has a head zone that provides cushioning for a user's head and two wings that are configured to extend away from the head zone such that the pillow is substantially U-shaped in the plane of the pillow, when deflated. A channel extends between the sheets of flexible material to connect the wings. The channel is positioned at a point in the head zone furthermost from the wing ends. The width of the channel increases from the center line such that when the pillow is inflated, the pillow has a substantially V-shaped profile that is formed about the centerline and centered on the channel.

15 Claims, 5 Drawing Sheets

(56) References Cited

U.S. PATENT DOCUMENTS

| | | | | |
|---|---|---|---|---|
| 3,017,221 | A | 1/1962 | Emery | |
| 3,243,828 | A * | 4/1966 | McCarty | 5/636 |
| 3,763,509 | A * | 10/1973 | Mittendorf | 5/640 |
| 4,345,347 | A | 8/1982 | Kantor | |
| D284,139 | S | 6/1986 | Ko | |
| 4,850,068 | A * | 7/1989 | Walpin et al. | 5/636 |
| D318,969 | S | 8/1991 | Byrn | |
| 5,544,378 | A | 8/1996 | Chow | |
| 5,813,065 | A * | 9/1998 | Tinhorn | 5/639 |
| 6,073,288 | A * | 6/2000 | Berenstein | 5/636 |
| 6,487,737 | B1 | 12/2002 | Futagami | |
| 6,539,567 | B1 * | 4/2003 | Bae | 5/638 |
| 6,546,579 | B1 * | 4/2003 | Leventhal et al. | 5/655.3 |
| 6,817,049 | B1 * | 11/2004 | Hall | 5/636 |
| D504,045 | S | 4/2005 | Rediske | |
| D611,285 | S | 3/2010 | Berland et al. | |
| D634,960 | S | 3/2011 | Anson | |
| D704,963 | S * | 5/2014 | McNeil et al. | D6/601 |
| 2003/0037376 | A1 * | 2/2003 | Zell | 5/636 |
| 2003/0135927 | A1 * | 7/2003 | Hsia | 5/640 |
| 2004/0195893 | A1 * | 10/2004 | Clough | 297/391 |
| 2005/0217029 | A1 * | 10/2005 | Funatogawa | 5/645 |
| 2005/0229314 | A1 * | 10/2005 | Chisari | 5/632 |
| 2005/0262637 | A1 * | 12/2005 | Funatogawa | 5/636 |
| 2006/0267392 | A1 | 11/2006 | Charnitski | |
| 2007/0226910 | A1 * | 10/2007 | Tidwell | 5/655 |
| 2007/0271702 | A1 * | 11/2007 | Graw | 5/636 |
| 2008/0104764 | A1 | 5/2008 | Chen | |

FOREIGN PATENT DOCUMENTS

| | | |
|---|---|---|
| DE | 4205650 | 11/1993 |
| EP | 1369065 | 12/2003 |
| GB | 385694 | 1/1933 |
| WO | 0182757 | 11/2001 |

OTHER PUBLICATIONS

Design Go Ltd, Neck Pillows+Sleep Accessories, www.design-go.com, 2007.

Examination Opinion issued by the European Patent Office on May 10, 2010, as an annex to the European Search Report.

* cited by examiner

PILLOW

FIELD OF INVENTION

The invention relates to pillows, and in particular to inflatable travel pillows that provide a comfortable support for a person using said pillow by providing a cushion support for a user's head when interposed between a user's head and a surface upon which a user's head is resting.

BACKGROUND

Known pillows come in various forms. The most basic pillows are generally rectangular in shape and can be inflated to provide a cushioned support. Although basic pillows often have an indentation, or similar such feature, for locating a user's head therein, such pillows are not adapted, or optimised, for user comfort because the three-dimensional shape formed by the pillow does not complement the natural shape of a user's head and neck when resting upon a surface. These pillows are adapted for use in a horizontal position.

Known improvements upon the generally rectangular shaped pillows have, in plan view, a U-shape profile. When inflated, these U-shaped pillows function like a collar, allowing a user's neck to be surrounded by the U-shaped profile of the pillow. These pillows are adapted for use in an inclined position.

Unfortunately, in use, the inventors have found that the "collar" type pillows provide limited lateral support to user's head. Further, the U-shaped profile, in particular the base portion of the "U", prevents a user's head and neck from resting in a natural position because a user's head located within the U-shaped pillow cannot fully rotate backwards to lie flat, or close to, the surface upon which the user is resting.

In effect, the portion immediately behind the neck unnaturally pushes the user's head forward towards the user's chest. Moreover, an inflated "collar" type pillow has a tendency to wrap around, or constrict a user's throat area.

Improvements to known collar-type pillows have had limited success. In one known example, the area at the base of the "U" that locates beneath a user's neck has been reduced in size to allow a user's head to rotate further rearwards towards the surface upon which a user is resting. Unfortunately, some of the other problems mentioned above remain.

It is against this background that the present invention has been made. This invention results from efforts to overcome the problems of known pillows. Other aims of the invention will be apparent from the following description.

STATEMENT OF INVENTION

The pillow of the invention is configured to channel a user's head towards the apex of a V-shaped profile formed in the pillow when inflated, to secure the user's head therein. A channel, furthermost from wing ends of the pillow is configured to provide a "pinch-point", or constriction zone, between the wings of the pillow to form the V-shape profile.

In one aspect, the invention resides in a pillow, comprising two sheets of flexible material, joined together to define a space, suitable for inflating to provide a cushioned support. The pillow has: a head zone for providing cushion means interposed between a user's head and the surface upon which said user is resting; two wings, configured to extend away from a centre line of the head zone towards wing ends such that the deflated pillow is substantially U-shaped in the plane of the pillow; a channel, defined between the sheets of flexible material, configured to connect the wings, and positioned at a point in the head zone remote from the wing ends, wherein the width of the channel increases from the centre line such that when the pillow is inflated, the pillow has a substantially V-shaped profile, formed about the centre line and centred about the channel. Other profiles may be formed at other parts of the pillow. Preferably, the channel is adjacent the edge of the pillow furthermost from the wing ends.

The pillow of the invention is advantageous because the pillow is configured to form, when inflated, a wedge shaped gap when viewed in elevation, such as a substantially V-shaped channel, between the wings, to securely locate a user's head therein. The pillow, when inflated, retains this shape relatively rigidly.

The gap may be defined by the wings extending upwardly, with respect to the surface on which the pillow is resting, from a point close to where the centre line passes through the head zone. Preferably, the apex of the V-shaped profile extends from the intersection of the centre line with the channel.

The channel narrows towards the centre line, when seen in elevation (normal to plane of sheets of flexible material) when inflated. The sides of the V-shape, defined by an upper sheet of the inflated pillow, may curve.

The V-shaped profile may define an angle, at the apex of the "V" greater than 10 degrees. The angle may be between of between 10 degrees and 180 degrees. Preferably, the angle is 150 degrees.

The V-shape profile may be dictated the degree by which the width of the channel increases from the centre line. By way of example, a small increase of the width of the channel over a predetermined distance may function to form a substantially obtuse apex, while a large increase in width over the same distance may function to form a narrower apex.

In effect, the channel has a waist formed about the centre line, where it narrows towards the narrowest point of the channel. Preferably, the width of the channel decreases smoothly towards the centre line. Preferably, the width of the channel at its narrowest point is not zero, as this helps to form a rigid V shape.

In effect, the V-shaped profile secures a user's head therein such that the centre of gravity of a user's head is biased towards the apex of the "V" and substantially recessed between the wings of the pillow, thus providing greater support and stability to a user's head, in use.

The centre line may be substantially equidistant between the wings, or may be symmetrical about the centre line.

The pinch-point, or constriction point, results in the wings adopting a V-shaped profile in its inflated resting position. In turn, this pushes the wings up in a direction of the users jaw line and/or chin, rather than merely resting on the shoulder blades in the same way as known pillows.

The head zone may be circular in shape in the plane of the cushion, or the head zone may take any shape, provided that it complements the forming of a V-shaped profile, when the pillow is inflated, by ensuring that the width of the channel increases from the centre line. The width direction is defined by the direction of the centre line.

The head zone may define an inflatable chamber to provide a cushioning surface for a user's head without the need for additional foam or cushioning. The inflatable chamber may be connected to the channel and/or the wings. The head zone may comprise a foam filled portion. The head zone may be an inflatable chamber and have a foam filled portion. The foam may be memory foam.

The head zone may be configured with a bridge connecting the wings. Preferably, the bridge may be arranged at a point in the head zone nearest the wings. The bridge may have a second channel configured to connect, by fluid communication, the wings.

The second channel and/or the bridge may increase in width from the centre line such that when the pillow is inflated, the pillow has a substantially V-shaped profile, centred about the second channel and/or the bridge. Therefore, the bridge may be shaped, and configured, to complement the formation of a V-shaped profile when the pillow is inflated.

The shape of the bridge may be configured such that the head zone is substantially flat, or preferably profiled to ergonomically match the shape of a user's head. In order to do so, the head zone may comprise foam, an air cushion, or a combination of foam and an air cushion portion.

Preferably, the second channel and/or the bridge may be shaped such that when the pillow is inflated, the head zone is substantially flat in the region closest to the wing ends and substantially V-shaped in profile, centred about the centre line of the channel.

The width of the second channel and/or the bridge may be greater than the width of the channel. It may be advantageous to control the shape of the head zone by controlling the width of the channel and the second channel and/or the bridge, the differences in the width dimensions between said elements being configured to control the shape of the head zone.

The width of the smallest part of the channel, bridge and/or second channel may be smaller than the width of the widest part of an adjacent wing.

The profile of the bridge and/or second channel may be dictated the degree by which the width of the bridge and/or second channel increase from the centre line.

The shape of the pillow, in plan view, is substantially U-shaped when in a deflated and an inflated condition. The edges of the "U" may be rounded or comprise straight line sections. In use, the U-shape may be arranged to leave open the area in front of a user's neck.

The pillow may have further additional sheets or layers of material, and may include 3 or more sheets. The additional sheets may be the same size, as the two sheets of flexible material, joined together to define a space, or may be smaller in size to cover a specific area of the exterior of the pillow. Additional sheets may be added to improve strength, comfort, durability and or appearance.

DESCRIPTION OF FIGURES

In order that the invention may be more readily understood, reference will now be made, by way of example, to the drawings in which:

FIG. 7A shows an end elevation view of an inflated pillow of the invention of the type shown in FIG. 1*b*, while

DETAILED DESCRIPTION

Figure 1A:
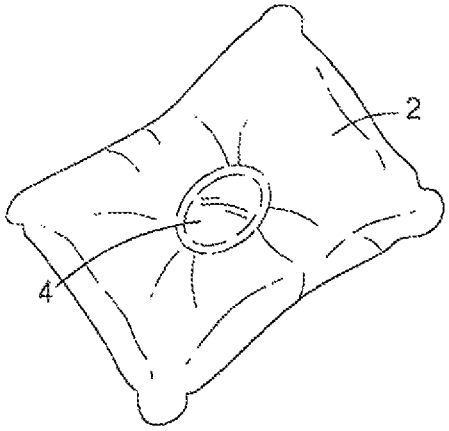
Fig.1a Prior Art
FIG. 1*a* is a perspective view of a known rectangular inflatable pillow.
Figure 1B:
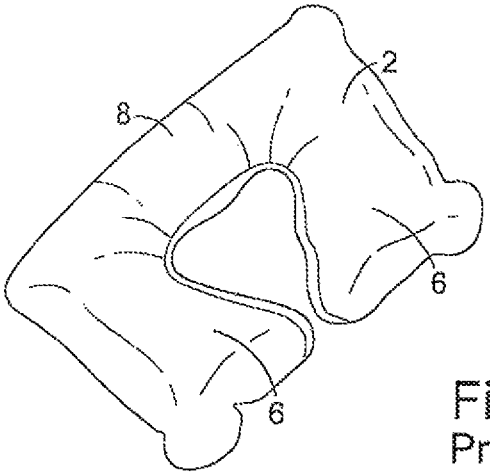
Fig.1b Prior Art
FIG. 1*b* is a perspective view of a known U-shaped, or collar-type, inflatable pillow.
Figure 1C:
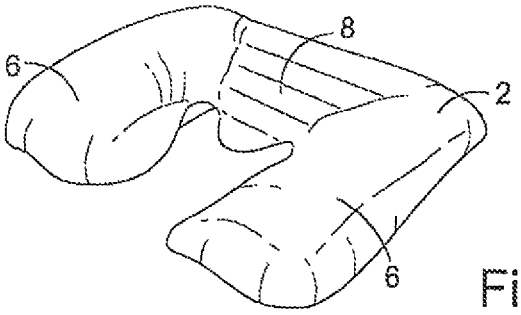
Fig.1c Prior Art
FIG. 1*c* is a perspective view of a known collar-type pillow having a shaped neck portion.
Figure 2A:
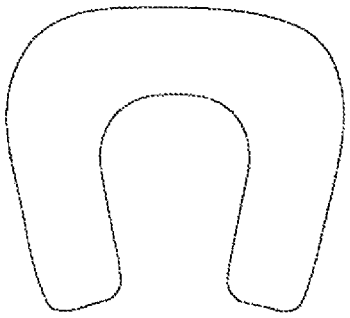
Fig.2a Prior Art
FIGS. 2*a* and 2*b* are schematic drawings showing a plan view and an elevation view, respectively, of the pillow shown in FIG. 1*b;*
Figure 2B:
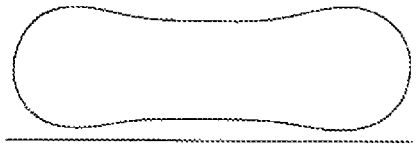
Fig.2b Prior Art
Figure 3A:
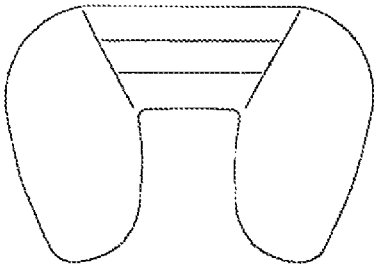
Fig.3a Prior Art
FIGS. 3*a* and 3*b* are schematic drawings showing a plan view and an elevation view, respectively, of the pillow shown in FIG. 1*c;*
Figure 3B:
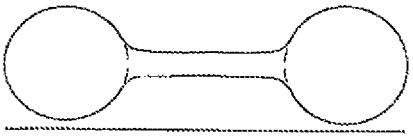
Fig.3b Prior Art

FIGS. 1*a* to 1*c* show known cushions in perspective view. Each cushion has an inflatable portion 2 and a rest area 4 for resting a head. The "collar-type" pillows shown in FIGS. 1*b* and 1*c* have arms 6 extending from the rest 4. A valve (not shown) is provided to inflate the pillows.

The pillow shown in FIG. 1*a* has a rest 4 defined by a flat portion in the centre of the inflatable portion. The recess created by the rest 4 allows a user's head to rest therein. When the inflatable portion 2 is inflated, the rest 4 is raised from the surface upon which the pillow is resting as a result of the inflatable portion expanding in each direction away from the rest 4. Therefore, in use, a user's neck would Test on the inflatable portion immediately adjacent the rest 4 upon which the user's head would rest. Ergonomically, a user's head, resting upon the cushion of FIG. 1*a*, would be unnaturally biased towards the chest of the user.

FIG. 1*b* has substantially the same features as the pillow of FIG. 1*a*. The principal difference between said pillows is the removal of the rest area 4 and a section of inflatable portion 2. As a result, the inflatable portion defines a U-shaped pillow. In light of the rest 4 being omitted, a user would rest their neck upon a neck rest 8, positioned in the base of the "U".

The pillow of FIG. 1*b* was developed to provide a cushion support for a user's neck when they are resting in a non-horizontal position. In use, a user's neck would rest between the arms 6 and rest upon the neck rest 8. In effect, the pillow forms a collar around the user's neck. Although the pillow shown in FIG. 1*b* enables a user's head and neck located therein to lie closer to the surface upon which a user is resting. Unfortunately, the neck rest 8 continues to bias the neck and head of a user towards the user's chest.

The arms 6 provide a degree of lateral support to a user's head; however, the forward biased position of the head is such that the head can easily roll between the arms 6. In effect, the position of the arms 6 with respect to a user's head is such that the centre of gravity of a user's head is held in a raised position above the plane defined by the pillow, which results in there being insufficient support for the head.

The pillow of FIG. 1*c* provides a rest 4, or neck rest 8, having a reduced depth, with respect to the arms 6, in the plane defined by the pillow. The lowered neck rest 8 of FIG. 1*c* allows a user's head to be positioned closer to the surface upon which the user is resting. However, the broad void created by the neck rest 8 exacerbates the problem of unsupported movement of a user's head when rested therein. Moreover, the thickness of the arms 6 maintain the rest 8 in a raised position such that the centre of gravity of a user's head is held in a raised position above the plane defined by the pillow, which results in there being insufficient support for the head.

Figure 4A:
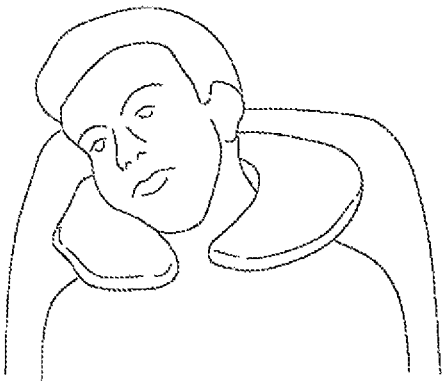
Fig.4a Prior Art
FIGS. 4*a* and 4*b* show a schematic representation of a user's head positioned, in use, in a known collar-type pillow typical of the pillow shown in FIG. 1*b;*
Figure 4B:
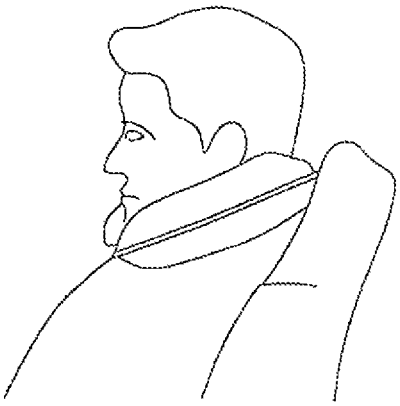
Fig.4b Prior Art

By way of example, FIG. 4*a* shows the pillow of FIG. 1*b* in use. The position of the pillow with respect to the user's neck and head allows the user's head to fall, or turn, to one side, as shown. FIG. 4*b* illustrates that the pillow of FIG. 1*b* biases the user's head towards the user's chest. In other words, known pillows provide limited lateral support and push a user's head forward because said pillows, in particular the pillows shown in FIGS. 1*b* and 1*c*, provide support primarily for the neck of a user without taking into account the heavy weight of a user's head and the centre of gravity of said head being at a raised distance from the plane defined by the cushion.

Figure 5A:
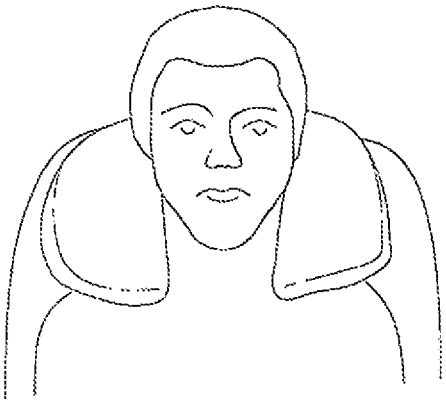
FIGS. 5*a* and 5*b* show a schematic representation of a user's head located in a pillow of the present invention.
Figure 5B:
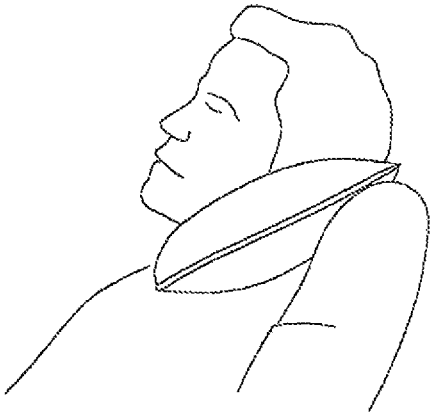

FIGS. 5*a* and 5*b* show a pillow according to the present invention, in use, in comparable circumstances to those shown in FIGS. 4*a* and 4*b*. In can be seen that the pillow of the invention provides lateral support to a user's head and enables a user's head to lie flat, with respect to the rest of the user's body, upon a surface upon which the user is resting. In effect, the pillow provides, simultaneously, support to the head and the neck of a user. By enabling a user's head to be channelled into the pillow, the centre of gravity of a user's head is biased towards the plane defined by the cushion, and greater comfort is achieved.

Figure 6:
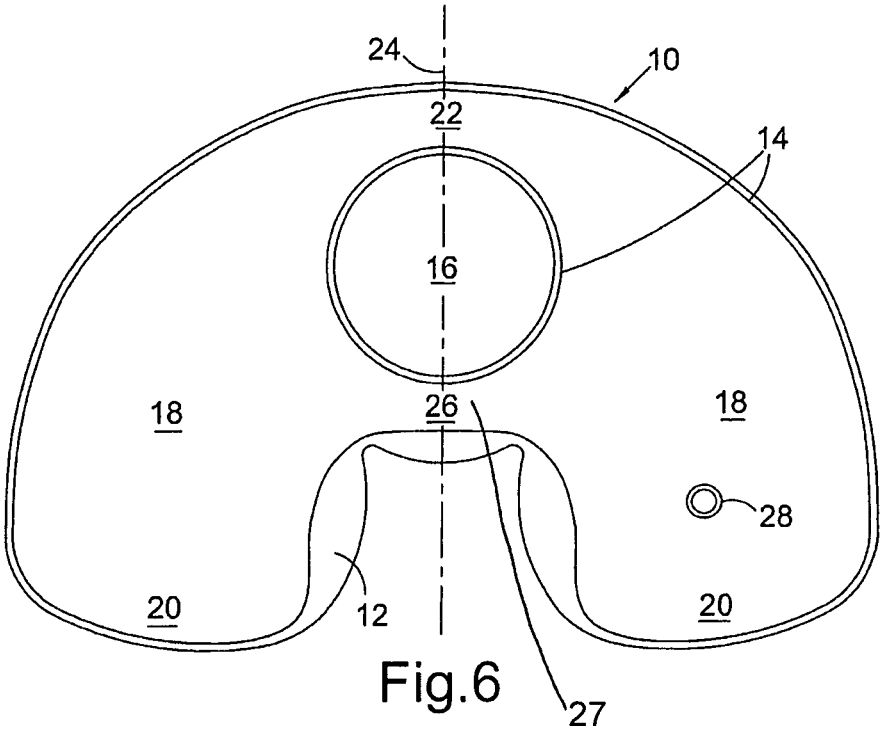
FIG. 6 shows a plan view of the pillow of the invention in a deflated condition.

FIG. 6 shows the components of a pillow 10 according to the present invention. Sheets of flexible material 12 are fixed together at welds 14 to define a head zone 16, wings 18, wing ends 20 and a channel 22, defined between the sheets of flexible material that connect the wings. A centre line 24, defined by a central portion of the bead zone 16, approximately equal distances from each of the wings 18, represents the centre line of the pillow.

As viewed in FIG. 6, the channel 22 is located at the top of the pillow, in the uppermost area of the head zone 16, while a bridge 26 is provided between the wings at the bottom of the head zone 16. The term "width" is defined as being a distance in the direction of the centre-line. An inflation point 28 is provided.

Structurally, the shape of the welds 14 on the sheets 12 defines the pillow. During manufacture, front and back sheets 12 are layered together before being connected by connection means such as stitching, adhesive, welding (heat, resistance, RF, ultrasound) or a combination to create the welds 14. The welds define the shape of the pillow 10, the head zone 16, the wings 18 and the wing ends 20. More importantly, the weld pattern defines the shape of the channel 22 and the bridge 26.

The pillow may be constructed of any suitable material, such as PVC. The pillow may be assembled from individual sheets, or a single sheet, folded over.

After the sheets are welded together, excess material is trimmed from the sheets to leave a footprint of material as shown in FIG. 6.

In the embodiment shown in FIG. 6, the head zone 16 is effectively sealed off from the wings 18. The head zone 16 may be provided with a foam cushion or may be inflated separately from a separate inflate point (not shown) from the inflate point 28. The formation of the welds 14 and head zone 16 are such that the channel defined between the sheets of flexible material increases in width as it extends from the centreline 24. In other words, the width of the smallest part of the channel is smaller than the width of the widest part of an adjacent wing.

In effect, the shape of the channel 22 as it extends from centreline 24 towards the wings 18 and wing ends 20 has a waist, narrowing about the centre line. On one side of the waist, the channel may have a corniculate, or funnel-like form. To be clear, the narrow end of the horn, or funnel, is represented by the waist, narrowest point, or "pinch-point" of the channel 22.

The pillow 10 is inflated via the inflation point 28. Upon inflation, the cavity between the sheets 12 expands such that the wings 18, the wing ends 20, and the channel 22 have a three-dimensional form.

Upon expansion, the pillow takes a three-dimensional form. In plan view, as shown in FIG. 6, the inflated pillow maintains a substantially U-shaped form. However, in an elevation view with respect to the surface upon which the pillow is resting, the pillow 10 is substantially V-shaped when viewed along the axis defined by the centreline 24. The pillow 10 forms a wedge shaped gap 29 in an elevation view with respect to the surface upon which the pillow is resting.

Figure 7A:
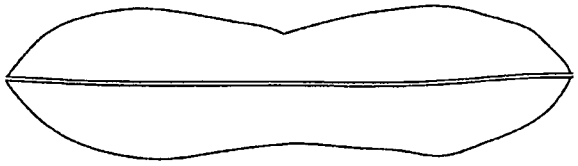
Fig.7A Prior Art

FIG. 7A shows a known pillow in end elevation of view. The end elevation view is representative of a view of a pillow shown in FIG. 1*b*. The pillow is generally elongate in shape having rounded ends and indentations created as a result of the expansion of the arms 6.

Figure 7B:
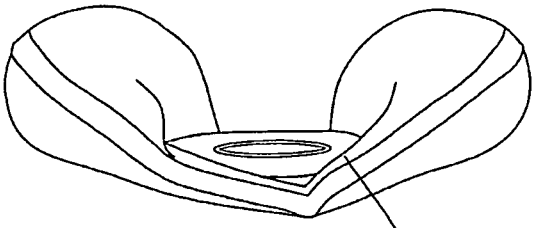
FIG. 7B shows an end elevation view of an inflated pillow according to the invention.

In comparison, the pillow of the invention, as shown in FIG. 7B, has a substantially V-shaped end elevation profile. The V-shaped profile is defined by the apex, which is formed in the region of the intersection between the centre line 24 and the channel 22.

As shown, the arms of the "V" extend vertically and are defined by the wings. Between the wings 18, a substantially flat head zone 16 is formed. The V-shaped profile allows a user's head to be channelled into the pillow such that the centre of gravity of a user's head lies closer to the surface upon which a user rests in comparison to known pillows.

Further, the wings of the pillow extend in an outward direction with respect to the head zone 16 such that the throat air of a user's neck remains exposed, the formation of the pillow 10 being formed such that the wings are inhibited from constricting the throat area. This difference can clearly be seen by comparing FIG. 4*a* and FIG. 5*a*.

The pillow of the invention provides cushioning support for both the head and the neck of a user. Referring back to FIG. 5*b*, it can be seen that the user's head rests upon the head zone 16 such that the wings 18 extend along the jaw line of a user providing adequate lateral support to the user's head.

Figure 8:
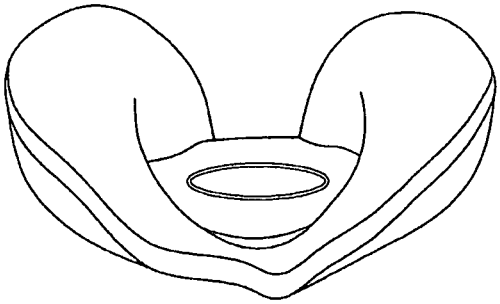
FIG. 8 shows a perspective view of an inflated pillow of the invention.

FIG. 8 shows a perspective view looking down into the pillow of the invention, in a direction from the channel towards the wing ends 22. It can be clearly seen that the channel 22 functions to provide the substantially V-shaped profile. The generally curved shape of the wings corresponds, ergonomically, to the shape of a user's head and neck to provide both head and neck support.

A user's head may rest in the apex of the V-shaped profile, being channelled therein, while providing sufficient space for the head to prevent a user feeling trapped.

Figure 9:
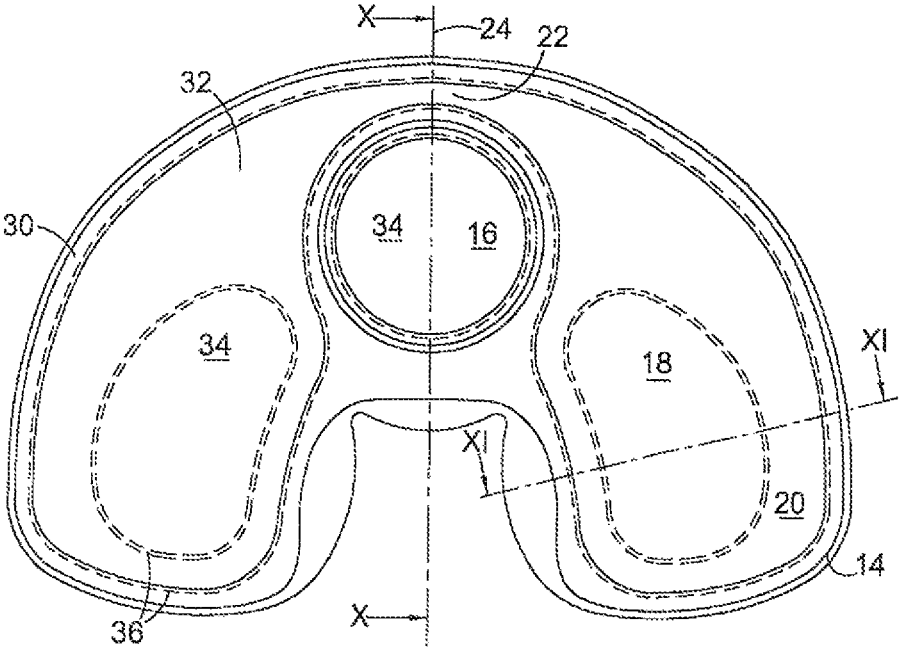
FIG. 9 shows a plan view of the invention, including indications of additional cushion areas, section X-X and section XI-XI.

FIG. 9 shows a plan view of the pillow of the invention, which is similar to that shown in FIG. 6. In addition to the sheets 12, the pillow may be provided with a flocked panel 30, a fleece cover 32 and areas incorporating memory foam 34. Stitching 36 is provided to secure the additional coverings to the pillow.

Figure 10:
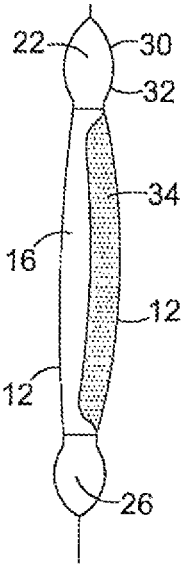
FIG. 10 is a cross-sectional view taken through section X-X of FIG. 9.
Figure 11:
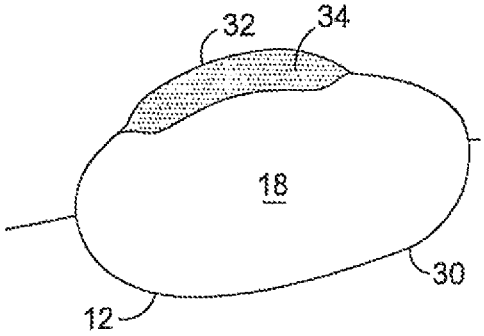
FIG. 11 is a cross-sectional view taken through section XI-XI of FIG. 9.

In order that the structure of the pillow 10 may be better understood, section X-X and section XI-XI are indicated in FIG. 9, with said sectional detail being shown, respectively, in FIGS. 10 and 11.

FIGS. 10 and 11 show in detail the front and back sheets 12, in addition to further sheets, in an inflated condition. When inflated, the sheets 12 form chambers to create the wings 18 and the channel 22. The application of additional coverings, in the form of the flocked covering 30, the fleece cover 32 and the memory foam portion 34 can be seen in FIGS. 10 and 11 in relation to the chambers of the channel 22 and the wing 18.

The bridge 26 forms a second channel 27 between the wings 18. Alternatively, the bridge 26 may form a sealed barrier between the wings 18. The shape of the bridge may be formed to complement the formation of the V-shaped profile of the pillow.

In another embodiment, not shown, the head zone 16 is not enclosed by welds 14 and, instead, is connected to the wings 18 and/or the channel 22, such that air blown into the pillow through the inflation point 28 serves to inflate the head zone 16 such that it functions as a cushion for a user's head.

A circular shape, or a series of ever decreasing circles, to complement the shape of a user's head, may define the head zone 16. However, any shape may be used that enables the pillow to form a substantially V-shaped profile around the centre line 24.

A crease along a portion of the centre line 24, in effect, forms the V-shaped profile. The crease is formed by a "pinch-point" that is formed by the limited size of the aperture in the channel 22 between the wings 18. By restricting the air passage between the wings 18, the channel 22 effectively buckles around its narrowest point.

The present invention has been described above purely by way of example, and modifications can be made within the spirit and scope of the invention, which extends to equivalents of the features described. The invention also exists in any individual features described or implicit herein or shown or implicit in the drawings or any combination of such features or any generalisation of such features of combination.

The invention claimed is:

1. A pillow, comprising:

two sheets of flexible material that are joined together to define a space and inflatable to provide a cushioned support, the sheets of material defining:

a head zone, extending along a centerline in a plan view, providing cushion means configured for a user's head to rest upon;

two wings, extending in a first direction and a second direction, respectively, away from the centerline and towards wing ends such that the pillow in a deflated state is substantially U-shaped in a horizontal cross-section of the pillow; and a channel, defined between the sheets of flexible material, configured to connect the wings, and positioned at a point in the head zone remote from the wing ends, wherein the width of the channel, the width being the dimension of the channel in the direction of the centerline, increases away from the centerline to a substantially V-shaped profile as viewed in elevation when the pillow is inflated, the V-shaped profile being centered between the wings, and wherein the head zone is substantially circular in plan view and comprises a foam-filled portion.

2. A pillow according to claim 1, wherein the centerline is substantially equidistant between the wings.

3. A pillow according to claim 1, wherein the head zone defines an inflatable chamber.

4. A pillow according to claim 1, wherein the head zone is configured with a bridge connecting the wings, the bridge being arranged at a point in the head zone nearest the wing ends.

5. A pillow according to claim 4, wherein the bridge has a second channel configured to provide fluid communication between the wings.

6. A pillow according to claim 4, wherein the bridge has a width, the width being a dimension of the bridge in a direction of the centerline that increases such that when the pillow is inflated, the pillow has a substantially V-shaped profile in elevation, centered about the bridge.

7. A pillow according to claim 5, wherein the second channel defines a width, the width being a dimension of the bridge in a direction of the centerline that that increases such that when the pillow is inflated, the pillow has a substantially V-shaped profile in elevation, centered about the second channel.

8. A pillow according to claim 4, wherein the bridge is shaped such that when the pillow is inflated, the head zone is substantially flat in the region closest to the wing ends and the pillow is substantially V-shaped in profile in elevation, centered about the centerline.

9. A pillow according to claim 5, wherein the second channel is shaped such that when the pillow is inflated, the head zone is substantially flat in the region closest to the wing ends and the pillow is substantially V-shaped in profile, centered above the centerline.

10. A pillow according to claim 4, wherein the bridge has a width, the width being a dimension of the bridge in a direction of the centerline that, as seen in plan view, is greater than the width of the channel.

11. A pillow according to claim 5, wherein the second channel has a width, the width being a dimension of the second channel in a direction of the centerline that, as seen in plan view, is greater than the width of the channel.

12. A pillow according to claim 1, wherein the width of the channel at a narrowest point is narrower than a width of a widest part of the wings adjacent the channel.

13. A pillow according to claim 4, wherein the width the channel at a narrowest point is narrower than a width of a widest part of the wings adjacent the channel.

14. A pillow according to claim 5, wherein the second channel has a width, the width being a dimension of the second channel in a direction of the centerline that increases as seen in plan view and the width of the second channel at a narrowest point is narrower than a width of a widest part of the wings adjacent the channel.

15. A pillow according to claim 1, wherein the pillow defines a wedge shaped gap with the head zone at the base of the gap.

* * * * *